US005706016A

United States Patent [19]

Harrison, II

[11] Patent Number: 5,706,016

[45] Date of Patent: Jan. 6, 1998

[54] TOP LOADED ANTENNA

[76] Inventor: Frank B. Harrison, II, 98 Colby Rd., Danville, N.H. 03819

[21] Appl. No.: 622,226

[22] Filed: Mar. 27, 1996

[51] Int. Cl.[6] ..... H01Q 9/00

[52] U.S. Cl. ..... 343/752; 343/749

[58] Field of Search ..... 343/749, 752, 343/773, 774, 846

[56] References Cited

U.S. PATENT DOCUMENTS

| | | | |
|---|---|---|---|
| 3,787,865 | 1/1974 | MacDowell et al. | 343/773 X |
| 4,635,068 | 1/1987 | Wheeler et al. | 343/749 |
| 4,987,423 | 1/1991 | Bouko et al. | 343/742 X |
| 5,099,249 | 3/1992 | Seavey | 343/700 MS |
| 5,181,044 | 1/1993 | Matsumoto et al. | 343/752 |
| 5,184,143 | 2/1993 | Marko | 343/749 |

OTHER PUBLICATIONS

A.G. Kandoian, "Three New Antenna Types and Their Applications"; Proc. IRE, 34, 70W –75W, Feb. 1946.

*Primary Examiner*—Donald T. Hajec
*Assistant Examiner*—Tho Phan

[57] ABSTRACT

A monopole antenna (1) is constructed with a ground plane disc (2), a top loaded antenna disc (3), and a length of coaxial cable (4) having an outer conductor (5) connected to the ground plane disc (2), an inner conductor (7) of the cable (4) being connected to the antenna disc (3), and a loading disc (6) between the ground plane disc (2) and the antenna disc (3), the loading disc (6) being connected to an outer conductor (5) of the cable (4).

4 Claims, 3 Drawing Sheets

TOP LOADED ANTENNA

FIELD OF THE INVENTION

The invention relates to a top loaded antenna having a disc as a radiating element above a ground plane.

BACKGROUND OF THE INVENTION

A short stub antenna mounted above a ground plane can be considered as an electric dipole in free space. A known antenna is constructed as a vertical stub of λ/4, meaning a quarter wavelength in length, extending above and transverse to a planar ground plane in the form of a conducting disc of about λ/2 diameter, meaning a diameter about one-half a wavelength. In a known construction, a coaxial cable of known characteristic impedance is connected to a feed point of the stub antenna, with an inner conductor of the cable connected to the stub, and an outer conductor terminated to the ground plane. The outer conductor of the cable comprises a hollow tubular shield concentric with the inner conductor. The dimensions of the stub length and the ground plane diameter determine the resonant frequency of the antenna.

As disclosed by, A. G. Kandoian, "Three New Antenna Types and Their Applications," *Proc. IRE*, Vo. 34, Pp. 70W–75W, February 1946., another stub antenna of compact size, known as a top loaded antenna, or a top loaded disc antenna, is achieved by replacing the stub with a planar disc of about λ/4 diameter spaced above the ground plane by a stub of reduced height. The advantage of a top loaded disc antenna resides in its reduced height and its less obtrusive appearance.

The terminal impedance of the antenna changes with frequency variations from the resonant frequency. The frequency sensitivity of the antenna, referring to impedance, is a function of how well the terminal impedance of the antenna matches the characteristic impedance of the coaxial feed at the frequency. A perfect impedance match is achieved when VSWR=1 at the resonant frequency of the antenna. The frequency band width is quite narrow for a perfect impedance match, since at higher relative frequencies, the VSWR levels increase.

Sometimes it is desired to make the VSWR less than a certain value over a wide frequency band, for example, an antenna is desired without perfect impedance match, to operate not only at the resonant frequency of the antenna, but to operate with a VSWR less than a certain value over a wider frequency band on both sides of a center frequency. For example, a representative stub antenna is constructed with a stub diameter of 0.050 inches and 3.150 inches in length, extending perpendicularly from a disc ground plane of 18 inches in diameter, results in a 16% bandwidth, typically, 140 Megacycles at less than 2.0:1 at 0.850 GHz. center frequency. A representative, top loaded disc antenna is constructed with a disc diameter of 1.5 inches, a thickness of 0.025 inches, and a stub height of 2.0 inches above a ground plane of 18 inches diameter. This top loaded antenna results in a 15% bandwidth, typically, 125 Megacycles at less than 2.0:1 at 0.850 GHz. The overall height in relation to wavelength is greater than 0.08λ.

One desired characteristic of a top loaded disc antenna resides in its reduced height above the ground plane. However, a top loaded disc antenna possesses operating characteristics that limit how much its height can be reduced.

SUMMARY OF THE INVENTION

According to the invention, a monopole antenna is constructed to result in a broad bandwidth with a lower profile, i.e. height, from a ground plane disc than a top loaded disc antenna.

According to the invention a monopole antenna is constructed as a top loaded disc antenna, together with a loading disc between the top loaded disc and a ground plane disc. An advantage of the invention is that a monopole antenna constructed with a loading disc has a resulting height of less than 0.08 λ while allowing extended bandwidth and gain over the bandwidth. Another advantage of the invention resides in a top loaded antenna wherein a coaxial cable connects to a feed point of a disc antenna element while a loading disc connected to a ground conductor of the cable is used for matching VSWR over an extended bandwidth.

The loading disc is used for matching VSWR to a ratio below 2.0:1 for an extended bandwidth and gain over the extended bandwidth. The loading disc is connected to the outer conductor of a coax cable used to feed the top loaded disc, such that the coax cable carries the characteristic impedance of the coax cable advantageously to the feed point of the antenna.

An embodiment of the invention resides in a loading disc between a ground plane disc and a top loaded disc antenna, with the loading disc being connected to a ground conductor of a coaxial cable.

Further, according to an embodiment of the invention, the outer conductor of the coax cable extends to a feed point of the disc antenna. The outer conductor of the cable extends between the loading disc and the top loaded disc to provide a constant impedance in close proximity to the second disc.

Another embodiment resides in an outer conductor of the cable supporting the disc antenna above the loading disc. The advantage is that the cable can be constructed with a rigid outer conductor instead of a flexible one.

An embodiment of the invention will now be described by way of example with reference to the drawings, according to which:

DETAILED DESCRIPTION

Figure 1:
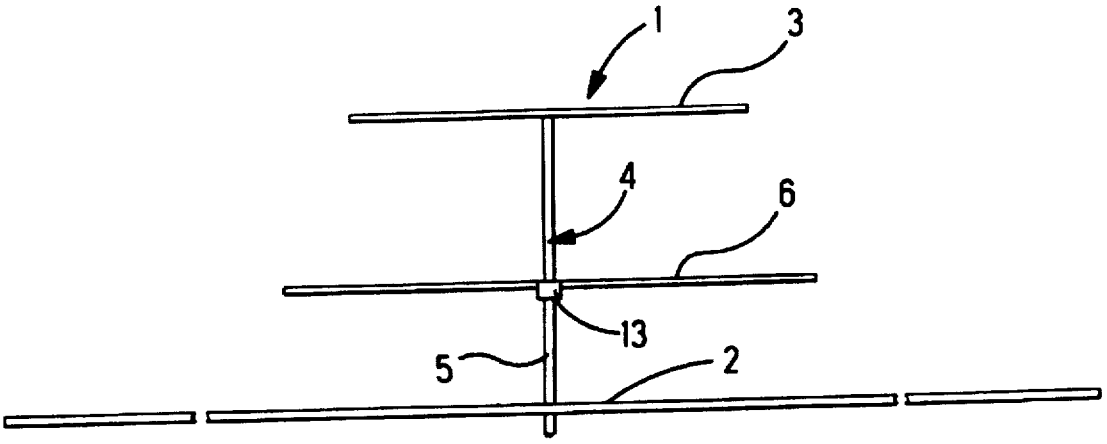
FIG. 1 is a side view of a monopole antenna constructed with a loading disc between a ground plane disc and a top loaded antenna disc.
Figure 2:
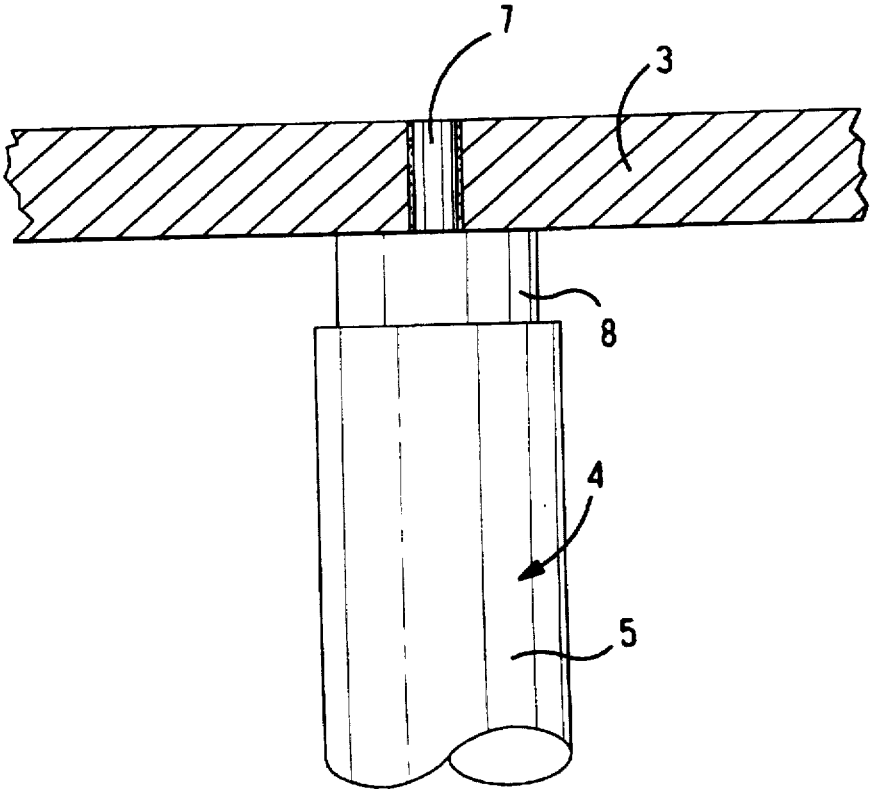
FIG. 2 is a fragmentary section view of a feed point of the antenna shown in FIG. 1.

With reference to FIG. 1, a monopole antenna 1 constructed as a top loaded disc antenna comprises, a ground plane disc 2, a top loaded antenna disc 3, and a length of coaxial cable 4 having an outer conductor 5 connected to the ground plane disc 2, and a loading disc 6 between the ground plane disc 2 and the antenna disc 3, the loading disc 4 being connected to the outer conductor 5 of the cable A feed point of the antenna 1 is shown in FIG. 2. With reference to FIG. 2, an inner conductor 7, of the cable 4 is connected by a solder joint to the antenna disc 3, at an aperture concentric with a center axis. The inner conductor 7 protrudes from a concentrically surrounding insulation 8, of the cable 1. The outer conductor 5 of the cable 1 is spaced away from the antenna disc 3 by a protruding portion of the concentric insulation 8 of the cable 1 that is concentric with the inner conductor 7 of the cable 1. For example, the space between the outer conductor and the antenna disc 3 is 0.015 inch. The external diameter of the cable 4 is 0.085 inch.

Figure 3:
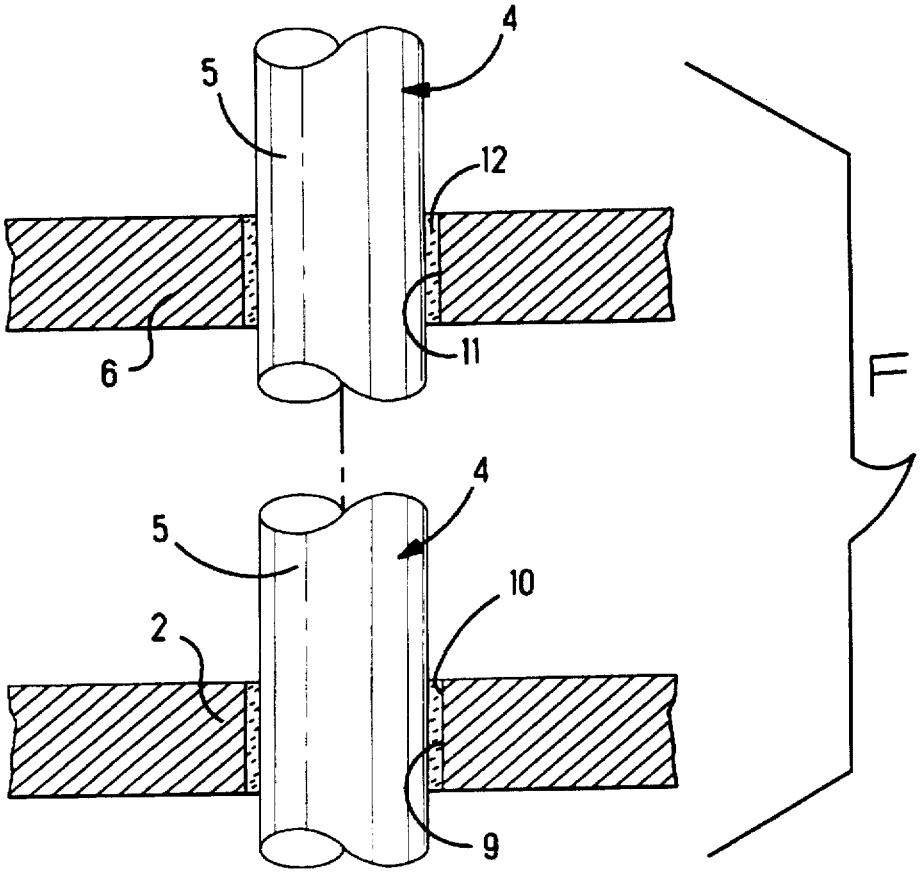
FIG. 3 is a fragmentary section view of a connection of a coaxial cable with the loading disc as shown in FIG. 1.

With reference to FIGS. 1 and 3, the cable 4 projects through an aperture 9 concentric with the central axis of the ground plane disc 2, with the outer conductor 5 of the cable 4 being terminated to the ground plane disc 2, for example, by a solder connection 10, FIG. 3. Alternatively, a coaxial connector, having a characteristic impedance matched to that of the coaxial cable, can be a blind mate connector or a threaded connector, and can be used to terminate the outer conductor 5, and the center or inner conductor 7 of the cable 1. A semirigid coaxial cable 4 is one wherein the outer conductor 5 is tubular, rigid, nonperforated metal. The semirigid coaxial cable 4 is stiff, capable of extending straight and is self-supporting. The semirigid coaxial cable 4 is difficult to flex. Accordingly, it may be desired to terminate an end of such a cable 4 to a coaxial connector that is mounted on the ground plane disc 2, rather than to project the cable 1 through the ground plane disc 2, as in FIG. 3, and having to flex and route the cable 4 where it extends below the ground plane disc 2. One such coaxial connector is described in U.S. Pat. No. 3,778,535, incorporated herein by reference, which is especially suited to terminate an end of a semirigid coaxial cable, for example, RG 141, wherein the outer conductor 5 is tubular, nonperforated metal. Whether the cable 4 extends through the ground plane disc 2, or is terminated by a coaxial connector mounted on the ground plane disc 2, the outer conductor 5 of the cable 4 is terminated to the ground plane disc 2, either by the solder connection 9, or by the coaxial connector. The semi-rigid cable 1 is self-supporting and provides a mast for supporting the disc antenna 3 and the loading disc 4 above the ground plane disc 2.

Advantageously, a semi-rigid coaxial cable 1, meaning, one having a rigid outer conductor 5, mechanically supports the antenna disc 3 above the ground plane disc 2. The need for a supporting structure, other than the coaxial cable 4, is advantageously eliminated, since the overall length of the coaxial cable 4 is short enough for the cable 4 to be self-supporting.

No further support structure is needed at the feed point, as shown in FIG. 2. Alternatively, for additional support, a sleeve of conducting metal can encircle the outer conductor of the cable. The larger diameter of such a sleeve, as compared with the diameter of the cable, would change marginally the impedance values over the band of frequencies.

For example, the antenna 1 is constructed with a ground plane disc 2 of 18 inches diameter and 0.025 inches thickness, an antenna disc 3 of 1.5 inches diameter and 0.025 inches thickness, and a coaxial cable 4 of 0.050 inches outer diameter. For a quarter wave length, top loaded antenna, without the loading disc 6, the antenna can be tuned to a center frequency of 0.850 GHz., which requires the overall height of the antenna to be 2.0 inches, to provide a 20% band width of 200 megacycles with WSWR less than 2:1. The coaxial cable 1 needs to be of sufficient length to elevate the antenna disc 3 to a required distance above the ground plane disc 2.

Figure 4:
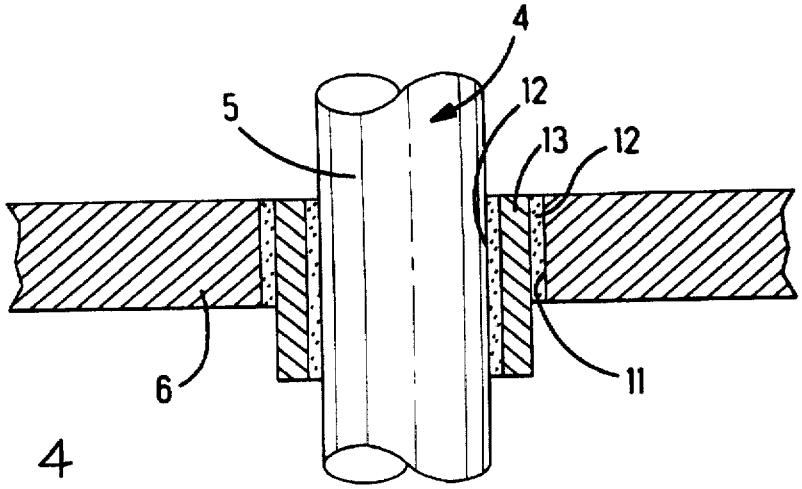
FIG. 4 is a fragmentary section view of a connection of a coaxial cable with a ground plane disc and a loading disc.
Figure 5:
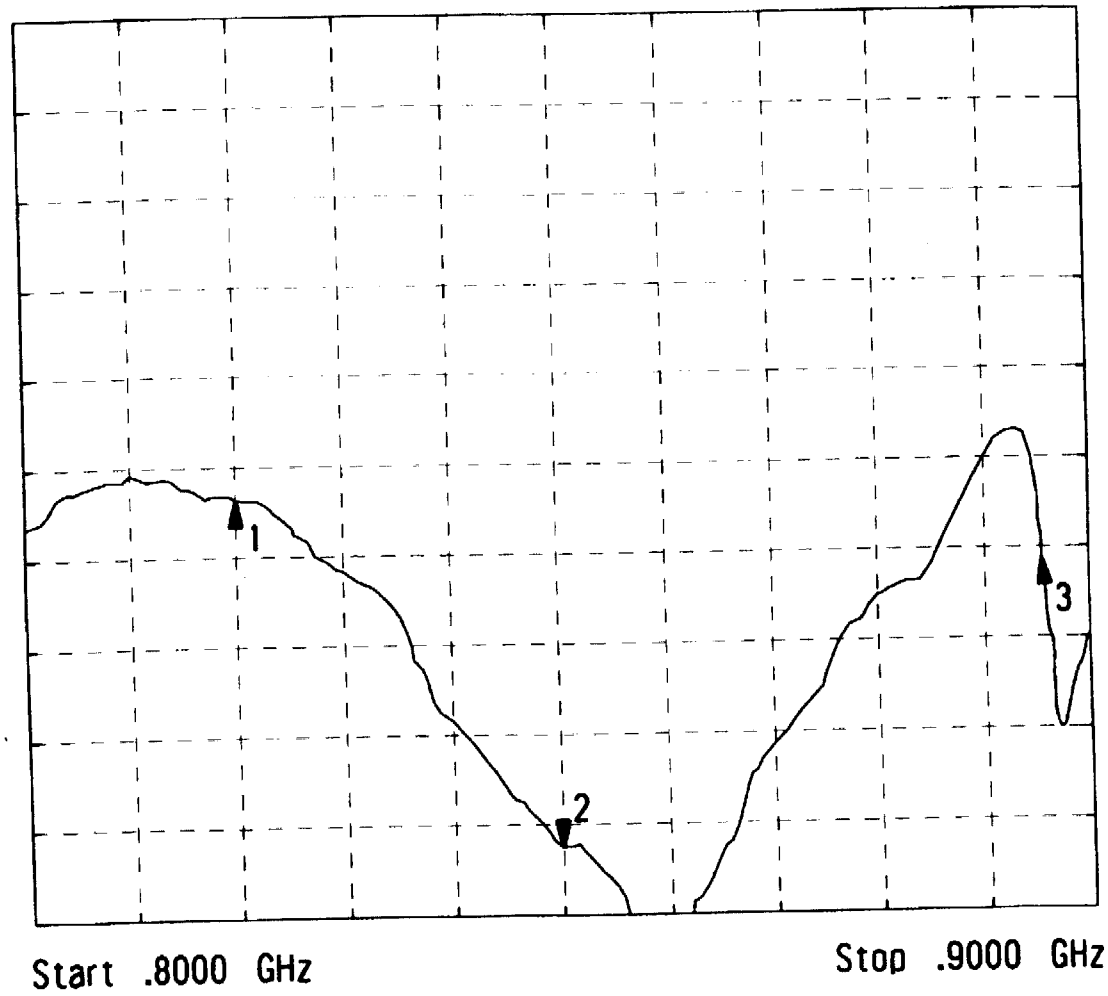
FIG. 5 is a graph of VSWR values over a bandwidth of frequencies on both sides of a center frequency of the antenna as shown in FIG. 1.

The presence of the loading disc 6 will reduce the height of a top loaded antenna without the loading disc 6. The effect of the loading disc 6 will now be described. With reference to FIG. 3, the loading disc 6 is of 2.0 inches diameter and 0.025 inches thickness. The coaxial cable 4 passes continuously through the center axis of the loading disc 6, wherein, the coaxial cable 4 passes continuously through an aperture 11 concentric with a center axis of the loading disc 6. The outer conductor 5 of the cable 4 is connected by a solder joint 12 to the loading disc 6 at the aperture 11. The loading disc 6 has a height from the ground plane disc 2 that is adjusted to resonate at the target frequency, or center frequency, 0.880 GHz., of the frequency band width. Because the loading disc 6 is relatively thin, a hollow cylindrical bushing 13, FIGS. 1 and 4, can line the aperture 11 through the loading disc 6, which reinforces the loading disc 6 where it is potentially weakened by the aperture 11. The coaxial cable 4 passes through the bushing 13 as well as the aperture 11 in which the bushing 13 is located. Both the cable 4 and the bushing 13 are soldered by respective solder joints 12 in the aperture 11.

The loading disc 6 is adjusted in position between the ground plane disc 2 and the antenna disc 3 for optimum VSWR in conjunction with its mechanical diameter. Also extended bandwidth, greater than usual bandwidth, is attained with gain over the entire frequency range. The loading disc 6 is adjusted in position by sliding the loading disc 6 along the outer conductor 5 of the coaxial cable 4 that provides a mast of the antenna 1. For various positions, the termination impedance values and a VSWR chart over the band of frequencies are measured and plotted. A VSWR of less than 2:1 over a 20% bandwidth at 0.850 GHz. center frequency is achieved by the antenna 1 constructed with an overall antenna height of merely 1.115 inches length, with the loading disc of 2.0 inches diameter, positioned along the coaxial cable 4 mast at 0.465 inches and 0.650 inches between the ground plane disc 2 and the top of the antenna 1, respectively. As shown in FIG. 3, data point number 2, measures −9.54 dB at 0.8500 GHz. Data point number 1 is −10.188 dB at 0.8200 GHz. Data point number 3 is −11.805 dB at 0.8960 GHz. Thus, a top loaded antenna 1 with an antenna disc 3 of 1.5 inches diameter, approximately one-quarter wavelength diameter, is reduced in height from 2.0 inches to 1.115 inches, by the use of the loading disc 6, and the bandwidth accompanied by substantial gain over the bandwidth is increased from 15% to 20%.

Other embodiments and modifications are intended to be covered by the spirit and scope of the claims, especially as pertaining to antennas tuned to different frequencies.

What is claimed is:

1. A monopole antenna comprising: a ground plane disc, a top loaded antenna disc, and a length of coaxial cable having an outer conductor connected to the ground plane disc, an inner conductor of the cable connected to the antenna disc, and a loading disc between the ground plane disc and the antenna disc, the loading disc being connected to the outer conductor of the cable.

2. A monopole antenna as recited in claim 1 wherein, the outer conductor of the cable extends between the loading disc and the top loaded antenna disc to provide constant impedance in close proximity to the antenna disc disc.

3. A monopole antenna as recited in claim 1 wherein, the cable passes continuously through an aperture concentric with a center axis of the loading disc, and the loading disc is slidable along the cable to adjust for optimum VSWR.

4. A monopole antenna as recited in claim 1 wherein, the cable passes continuously through an aperture concentric with a center axis of the loading disc, and the outer conductor of the cable is soldered to the loading disc at the aperture.

* * * * *